US007826755B2

(12) United States Patent
Naoi et al.

(10) Patent No.: US 7,826,755 B2
(45) Date of Patent: Nov. 2, 2010

(54) IMAGE FORMING APPARATUS AND DRIVE CONTROL METHOD OF THE SAME

(75) Inventors: Hiroo Naoi, Nara (JP); Kohichi Takenouchi, Tenri (JP); Mitsuru Tokuyama, Kizugawa (JP); Kiyofumi Morimoto, Tenri (JP); Kazuma Hinoue, Yamatokoriyama (JP); Tomoki Minamikawa, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 80 days.

(21) Appl. No.: 12/334,332

(22) Filed: Dec. 12, 2008

(65) Prior Publication Data

US 2009/0175635 A1 Jul. 9, 2009

(30) Foreign Application Priority Data

Jan. 8, 2008 (JP) ..... 2008-001072

(51) Int. Cl.
*G03G 15/00* (2006.01)
*G03G 15/01* (2006.01)

(52) U.S. Cl. ..... 399/43; 399/44; 399/223; 399/298

(58) Field of Classification Search ..... 399/43, 399/26, 38, 44, 223, 298, 299
See application file for complete search history.

(56) References Cited

U.S. PATENT DOCUMENTS 5,376,998 A 12/1994 Suzuki et al.
2004/0136742 A1 * 7/2004 Saito et al. ..... 399/223
2005/0069334 A1 * 3/2005 Hashimoto et al. ..... 399/299
2007/0025778 A1 * 2/2007 Akizuki et al. ..... 399/299

FOREIGN PATENT DOCUMENTS

| | | |
|---|---|---|
| JP | 5-197254 A | 8/1993 |
| JP | 2002-148888 | 5/2002 |
| JP | 2002-148889 A | 5/2002 |
| JP | 2007-65631 | 3/2007 |

* cited by examiner

*Primary Examiner*—Sophia S Chen
(74) *Attorney, Agent, or Firm*—Birch, Stewart, Kolasch & Birch, LLP

(57) ABSTRACT

An image forming apparatus capable of performing monochrome printing and color printing in which all the developing units share a single development transformer is constructed such that at the time of monochrome printing the photoreceptor drums for colors are stopped rotating while all the developing units are constantly applied with a high voltage. Further, the cumulative operation time in which the black photoreceptor drum has been operated for monochrome printing is calculated so that the color-printing photoreceptor drums which are stopped during monochrome printing are rotationally driven by a predetermined angle when the cumulative operation time exceeds predetermined fixed time. Thus, the surface of each color-printing photoreceptor drum that is being worn is restored by making the fresh surface of the drum oppose the associated color developing unit, whereby it is possible to prevent occurrence of defects on the surface of each photoreceptor drum.

6 Claims, 4 Drawing Sheets

IMAGE FORMING APPARATUS AND DRIVE CONTROL METHOD OF THE SAME

This Nonprovisional application claims priority under 35 U.S.C. §119(a) on Patent Application No. 2008-001072 filed in Japan on 8 Jan. 2008, the entire contents of which are hereby incorporated by reference.

BACKGROUND OF THE INVENTION (1) Field of the Invention

The present invention relates to an image forming apparatus using electrophotography such as a copier, printer, facsimile machine or the like, in particular, relating to a tandem type image forming apparatus.

(2) Description of the Prior Art

In conventional color printers, color multi-functional machines and the like, when a monochrome mode printing (including text printing) is implemented, usually no color image forming for colors (C/M/Y) is carried out, hence the photoreceptors and developing units for colors are kept from driving without applying any high voltage to the developing units while the photoreceptor and developing unit for black (BK) alone are driven. These image forming apparatus often employ a configuration in which two or more number of development transformers for image forming are used. Because the development transformer including the control circuit for controlling the transformer is markedly expensive, provision of such a development transformer for each developing unit leads to sharp increase of the machine cost.

When monochrome printing is selected in a system using an intermediate transfer element, it is necessary to perform control so as to stop not only the photoreceptors and developing units for colors but also to move and kept the intermediate transfer element away from the photoreceptors for colors or the like.

In view of cut down the cost of the machine, there has been devised a configuration in which one common development transformer is shared by all the developing units while high voltage is adapted to be applied also to C/M/Y color developing units even in a monochrome mode. Alternatively, patent document 1 (Japanese Patent Application Laid-open H5-197254) discloses an image forming apparatus of a fixed developing unit system in which a single developing bias power source is used in common so as to supply power only to the developing units that are activated by a switching means.

In the above way, according to the aforementioned conventional image forming apparatus, miniaturization and cost down of the machine are achieved by enabling the apparatus to operate with only a single development transformer, which is high in price.

However, in the configuration in which a single developing transformer is shared so as to constantly apply high voltage to each developing unit, there is the problem that when the photoreceptors for colors are stopped to drive, there occurs electric damage to each of the photoreceptors opposing the color developing units, producing defects on their surfaces.

Also, in patent document 1 (Japanese Patent Application Laid-open H5-197254), high accuracy of control timing is demanded in switching control of the developing bias voltage from the developing bias power source, hence the switching control circuit cannot but become complicated.

SUMMARY OF THE INVENTION

In view of the above, it is therefore an object of the present invention to provide an image forming apparatus of a tandem type using a single common developing bias power source, in which damage to the photoreceptors for colors is reduced to as low as possible.

In order to achieve the above object, the present invention has the following configurations and is characterized as follows.

An image forming apparatus of the present invention is one that is capable of performing monochrome printing and color-printing in a switchable manner, comprising: a plurality of photoreceptor drums; a plurality of developing units; a single intermediate transfer element; a plurality of drives for driving the plural photoreceptor drums; a single development transformer for supplying voltage to the plural developing units; a cumulative operation time measuring unit for calculating cumulative operation time for which the photoreceptor drum for monochrome printing has been used in the monochrome printing; and, a controller for rotationally driving the photoreceptor drums for color printing by a predetermined angle, and is characterized in that the controller stops rotation of the photoreceptor drums for color printing during monochrome printing while applying the developing voltage from the single development transformer to all the developing units, and compares the cumulative operation time calculated by the cumulative operation time measuring unit with a cumulative operation threshold time and rotationally drives the photoreceptor drums for color printing by a predetermined angle when the cumulative operation time is determined to reach the cumulative operation threshold time.

The image forming apparatus of the present invention is characterized in that the cumulative operation time measuring unit calculates the cumulative operation time based on the number of printouts or the rotated time of the photoreceptor drum for monochrome printing.

Also, the image forming apparatus of the present invention is characterized in that the controller increases the angle by which the photoreceptor drums for color printing are rotationally driven, in accordance with the total cumulative number of rotations of the photoreceptor drum for monochrome printing.

The image forming apparatus of the present invention is characterized in that the controller changes the lapse of time before the photoreceptor drums for color printing is rotationally driven, in accordance with the total cumulative number of rotations of the photoreceptor drum for monochrome printing.

The image forming apparatus of the present invention further includes a temperature sensor for measuring the ambient temperature of the apparatus, and is characterized in that the cumulative operation time measuring unit modifies the cumulative operation threshold time by multiplying the cumulative operation threshold time by a correction coefficient selected in accordance with the ambient temperature measured by the temperature sensor.

Further, the image forming apparatus of the present invention is characterized in that the controller resets the cumulative operation time calculated by the cumulative operation time measuring unit when the monochrome printing ends.

A drive control method for an image forming apparatus of the present invention is applied to an image forming apparatus capable of performing monochrome printing and color printing in a switchable manner, including: a plurality of photoreceptor drums; a plurality of developing units; a single development transformer for supplying a developing voltage to the plural developing units; and a single intermediate transfer element, and comprises the step of: stopping rotation of the photoreceptor drums for color printing at the start of monochrome printing while applying the developing voltage from the single development transformer to all the developing units; calculating the cumulative operation time based on a cumulative operation time measuring unit for calculating the cumulative operation time of the photoreceptor drum for monochrome printing; comparing the cumulative operation time calculated by the cumulative operation time measuring unit for calculating the photoreceptor drum for monochrome printing, with a cumulative operation threshold time to determine whether the cumulative operation time has reached the cumulative operation threshold time; and, rotationally driving the photoreceptor drums for color printing by a predetermined angle when the cumulative operation time is determined to have reached the cumulative operation threshold time.

According to the thus constructed image forming apparatus of the present invention, it is possible to make the image forming apparatus as whole compact and also cut down the cost. Further, it is possible to suppress degradation due to coating wear-out of the photoreceptor drums.

Further, according to the image forming apparatus of the present invention, since the cumulative operation time is calculated based on the number of printouts or the rotated time of the photoreceptor drum, it is possible to easily detect degradation of the photoreceptor drums.

According to the image forming apparatus of the present invention, since the photoreceptor drums become prone to degrade as they approach the end of life, the predetermined distance (the rotating angle) by which the photoreceptor drums for colors are rotationally driven is made greater so as to reduce the influence from that.

Further, according to the image forming apparatus of the present invention, since the time before the photoreceptor drums for color printing are rotationally driven is changed in accordance with the total cumulative number of rotations of the monochrome printing photoreceptor drum, it is possible to reduce the influence from degradation of the photoreceptor drums which become prone to worn away as they approach the end of life.

According to the image forming apparatus of the present invention, since the cumulative operation threshold time is modified by multiplying a correction coefficient in accordance with the ambient temperature, it is possible to constantly produce clear images and text printing, by making correction taking into account the influence of the ambient temperature which will give great influence on image quality.

Finally, according to the image forming apparatus of the present invention, the cumulative operation time is reset, so that the photoreceptor drums are rotated periodically before they are degraded too far, hence it is possible to positively lengthen the lives of the photoreceptors.

DESCRIPTION OF THE PREFERRED EMBODIMENTS

An image forming apparatus according to the best embodied mode of the invention will hereinafter be described in detail with reference to the accompanying drawings.

To begin with, before describing the specific configuration and operation of the image forming apparatus according to the present application, the overall schematic configuration and operation of the image forming apparatus will be described briefly.

Figure 1:
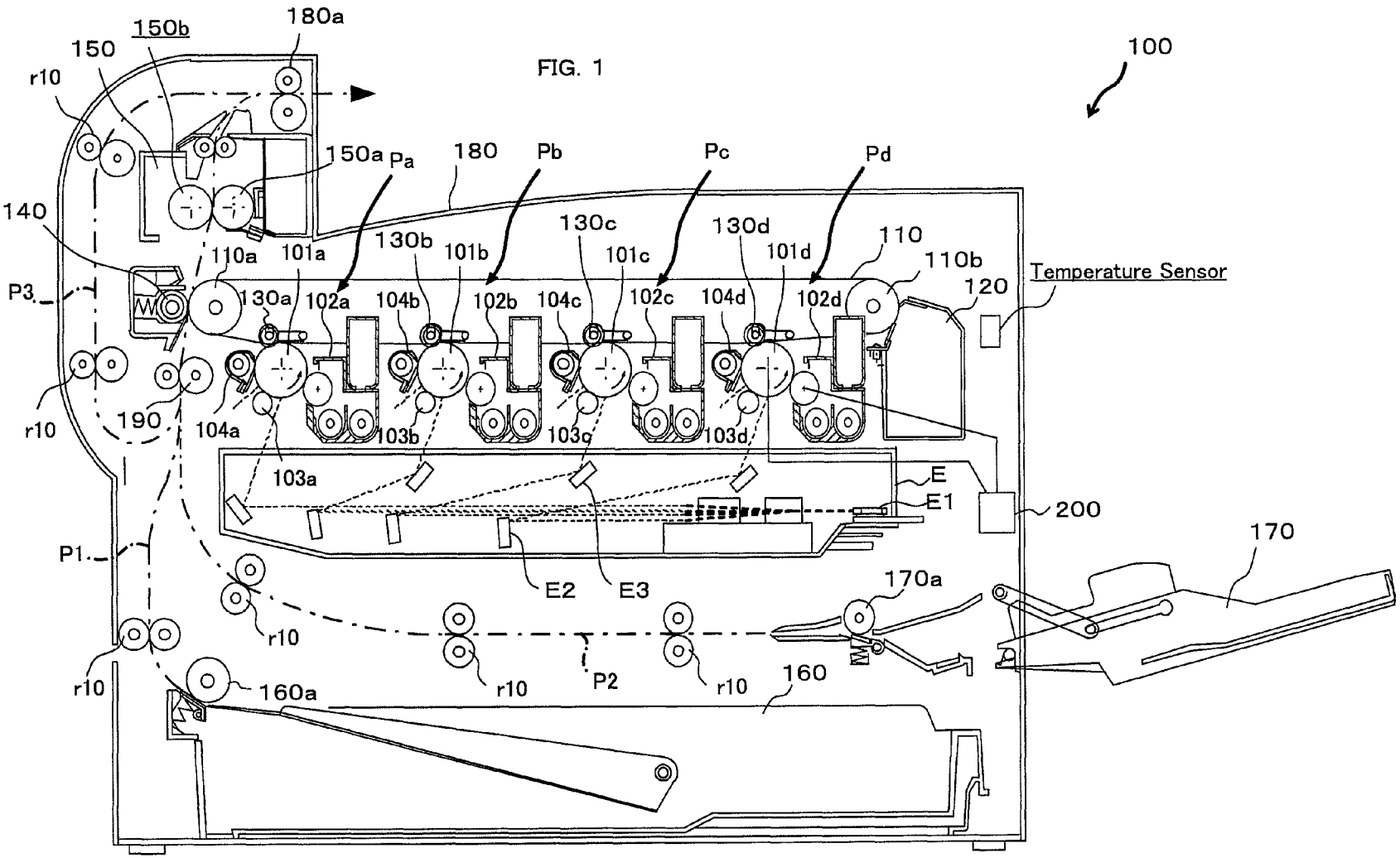
FIG. 1 is an overall structural view showing a schematic configuration of an image forming apparatus according to the present embodiment.

FIG. 1 is an overall structural view showing a schematic configuration of an image forming apparatus according to the present embodiment.

An image forming apparatus 100 according to the present embodiment forms multi-colored or monochrome images on paper based on the image data of scanned originals or the image data transmitted via a network etc. For this purpose, image forming apparatus 100 includes: an exposure unit E; photoreceptor drums 101 (101*a* to 101*d*); developing units 102 (102*a* to 102*d*); charging rollers 103 (103*a* to 103*d*); cleaning units 104 (104*a* to 104*d*); an intermediate transfer belt 110; primary transfer rollers 130 (130*a* to 130*d*); a secondary transfer roller 140; a fuser 150; paper feed paths P1, P2 and P3; a paper feed cassette 160; a manual paper feed tray 170; and a paper output tray 180.

The image forming apparatus 100 thus constructed as above performs image forming at image forming portions Pa to Pd using image data corresponding to respective four colors, i.e., black (K), and cyan (C), magenta (M) and yellow (Y), the three prime colors of subtractive color mixture that are obtained by color separation of color images. Image forming portions Pa to Pd have the same configurations. For example, image forming portion Pa for black (K) is composed of photoreceptor drum 101*a*, developing unit 102*a*, charging roller 103*a*, transfer roller 130*a* and cleaning unit 104*a* and the like. These image forming portions Pa to Pd are arranged in a row in the intermediate transfer belt 110's direction of movement (sub scan direction).

Charging roller 103 is a charging device of a contact type which uniformly electrifies the photoreceptor drum 101 surface at a predetermined potential. Here, a contact-type charger using a charging brush or a non-contact type charger using charging wire may also be used instead of charging roller 103.

Exposure unit E as the exposure device includes an unillustrated semiconductor laser, a polygon mirror E1, a first reflecting mirror E2 and a second reflecting mirror E3, and illuminates photoreceptor drums 101*a* to 101*d* with light beams, i.e., laser beams, that are modulated based on the image data of separate colors, that is, black, cyan, magenta and yellow. Formed on photoreceptor drums 101*a* to 101*d* are electrostatic latent images based on the image data of respective colors of black, cyan, magenta and yellow.

Developing unit 102 supplies toner to the photoreceptor drum 101 surface with an electrostatic latent image formed thereon to develop the latent image into a toner image. Developing units 102*a* to 102*d* store black, cyan, magenta and yellow color toners, respectively so as to develop the electrostatic latent images for colors formed on photoreceptor drums 101*a* to 101*d* into toner images of black, cyan, magenta and yellow colors. Cleaning unit 104 removes and collects the toner remaining on the photoreceptor drum 101 surface after development and image transfer.

Intermediate transfer belt 110 arranged over photoreceptor drums 101 is wound and tensioned between a drive roller 110*a* and a driven roller 110*b*, forming a looped moving path. Arranged opposing the outer peripheral surface of intermediate transfer belt 110 are photoreceptor drum 101*d*, photoreceptor drum 101*c*, photoreceptor drum 101*b* and photoreceptor drum 101*a* in the order mentioned. Primary transfer rollers 130*a* to 130*d* are arranged at positions opposing respective photoreceptor drums 101*a* to 101*d* across this intermediate transfer belt 110. The positions at which intermediate transfer belt 110 opposes photoreceptor drums 101*a* to 101*d* form respective primary transfer stations. This intermediate transfer belt 110 is formed of a film of about 100 μm to 150 μm thick.

In order to transfer the toner images carried on the surfaces of photoreceptor drums 101*a* to 101*d* to intermediate transfer belt 110, each of primary transfer rollers 130*a* to 130*d* is applied by constant-voltage control with a primary transfer bias that has the opposite polarity to that of the static charge on the toner. With this arrangement, the toner images of individual colors formed on photoreceptor drums 101 (101*a* to 101*d*) are successively transferred, one over the other, to the outer peripheral surface of intermediate transfer belt 110 so that a full-color toner image is formed on the outer peripheral surface of intermediate transfer belt 110.

If image data involving only part of colors of yellow, magenta, cyan and black is inputted, among the four photoreceptor drums 101*a* to 101*d* electrostatic latent images and hence toner images are formed only for the photoreceptor drums 101 that correspond to the colors of the input image data. For examples upon monochrome image forming, only the electrostatic latent image or toner image for photoreceptor drum 101*a* corresponding to black color is formed, so that the black toner image alone is transferred to the outer peripheral surface of intermediate transfer belt 110.

Each of primary transfer rollers 130*a* to 130*d* is composed of a shaft formed of metal (e.g., stainless steel) having a diameter of 8 to 10 mm and a conductive elastic material (e.g., EPDM, foamed urethane, etc.,) coated on the shaft surface, and uniformly applies a high voltage to intermediate transfer belt 110 through the conducive elastic material.

The toner image formed on the outer peripheral surface of intermediate transfer belt 110 by image transfer at primary transfer stations is conveyed as intermediate transfer belt 110 rotates to the secondary transfer station where the belt opposites secondary transfer roller 140. During image forming, secondary transfer roller 140 is abutted with a predetermined nip pressure against the outer peripheral surface of intermediate transfer belt 110, in the area where the interior side of intermediate transfer belt 110 comes into contact with the peripheral surface of drive roller 110*a*. When paper fed from paper feed cassette 160 or manual paper feed tray 170 passes through the nip between secondary transfer roller 140 and intermediate transfer belt 110, a high voltage of a polarity opposite the polarity of the static charge on the toner is applied to secondary transfer roller 140. This causes the toner image to transfer from the outer peripheral surface of intermediate transfer belt 110 to the paper surface.

The toner that has been transferred from photoreceptor drums 101 to intermediate transfer belt 110 and remains on intermediate transfer belt 110 without being transferred to the paper is collected by cleaning unit 120 in order to prevent color contamination at the next operation.

The paper with the toner image transferred thereon is lead to fuser 150 and heated and pressurized while passing through between heat roller 150*a* and pressure roller 150*b*. Thereby, the toner image is firmly fixed to the paper surface. The paper with the toner image fixed thereon is discharged by a paper discharge roller 180*a* onto paper output tray 180.

Image forming apparatus 100 includes a paper feed path P1 that extends approximately vertically to convey the paper stacked in paper feed cassette 160 to paper output tray 180 by way of the nip between secondary transfer roller 140 and intermediate transfer belt 110 and fuser 150. Arranged along paper feed path P1 are a pickup roller 160*a* for delivering paper from paper feed cassette 160, sheet by sheet, into paper feed path P1, conveying rollers r10 for conveying the delivered paper upwards, a registration roller 190 for leading the conveyed paper to the nip between secondary transfer roller 140 and intermediate transfer belt 110 at a predetermined timing and paper discharge roller 180*a* for discharging the paper to paper output tray 180.

Image forming apparatus 100 also incorporates a paper feed path P2 that extends from manual paper feed tray 170 to registration roller 190, having a pickup roller 170*a* and conveying rollers r10 arranged therealong. There is also another paper feed path P3 that extends from paper discharge roller 180*a* toward the upstream side of registration roller 190 in paper feed path P1.

Paper discharge roller 180*a* is adapted to rotate in both forward and reverse directions, and is rotated in the forward direction to discharge the paper to paper output tray 180 at the time of one-sided image forming for forming an image on one side of the paper and at the time of the second side image forming in duplex image forming for forming images on both sides. On the other hand, at the time of the first side image forming in duplex image forming, paper discharge roller 180*a* is driven in the forward direction until the rear end of the paper passes by fuser 150 and then rotated in reverse while it is holding the rear end of the paper to lead the paper into paper feed path P3. Thereby, the paper with an image formed on only one side thereof during duplex image forming is lead to paper feed path P1 with its printed face down and its front edge inverted to the rear.

Registration roller 190 leads the paper that has been fed from paper feed cassette 160 or manual paper feed tray 170 or that has been conveyed through paper feed path P3, to the nip between secondary transfer roller 140 and intermediate transfer belt 110 at a timing synchronized with the rotation of intermediate transfer belt 110. For this purpose, registration roller 190 stops rotating when photoreceptor drums 101 and intermediate transfer belt 110 start operating, while the paper that was started to be fed or conveyed in advance of rotation of intermediate transfer belt 110 is stopped from moving in paper feed path P1 with its front end abutting against registration roller 190. Thereafter, registration roller 190 starts rotating at such a timing that the front edge of the paper and the front end of the toner image formed on intermediate transfer belt 110 meet each other at the position where secondary transfer roller 140 and intermediate transfer belt 110 come in pressure contact with each other.

Here, when full-color image forming is performed using all the image forming portions Pa to Pd, primary transfer rollers 130*a* to 130*d* are made to abut intermediate transfer belt 110 against respective photoreceptor drums 101*a* to 101*d*. On the other hand, when monochrome image forming is performed with image forming portion Pa alone, the primary transfer roller 130*a* alone is made to abut intermediate transfer belt 110 against photoreceptor drum 101*a*.

<Description of the Basic Configurational Concept of the Image Forming Apparatus of the Present Invention>

Next, the bias configurational concept of the image forming apparatus of the present invention constructed as above will be described.

Image forming apparatus 100 of the present invention is characterized by its developing units 102. Specifically, the image forming apparatus 100 of the present invention is constructed such that developing units 102 share a single development transformer, which constantly applies high voltage to each developing unit while color-printing photoreceptors 101*b* to 101*d* are adapted to stop their rotational drive during monochrome printing, and that the cumulative operation time of black photoreceptor drum 101*a* for monochrome printing is calculated, and when this calculated time exceeds a predetermined fixed time (cumulative operation threshold time T), the unoperated color-printing photoreceptor drums are rotationally driven by a predetermined angle (equivalent to the circumferential distance corresponding to the angle).

With this configuration, color-printing photoreceptor drums 101*b* to 101*d* are forcibly rotated by a predetermined angle so as to restore the photoreceptor surface, which is being degraded, by making the fresh surface in each drum oppose the color developing unit, whereby it is possible to suppress electric damage to each photoreceptor that opposes the color developing unit and prevent occurrence of defects on the photoreceptor drum surface. Further, no complicated control drive circuit is needed, hence it is possible to cut down the cost of the apparatus.

<Specific Configuration and Operation of the Image Forming Apparatus According to the First Embodiment>

Now, the configuration of image forming apparatus according to the first embodiment, mainly the configuration of the controller including a CPU will be described.

Figure 2:
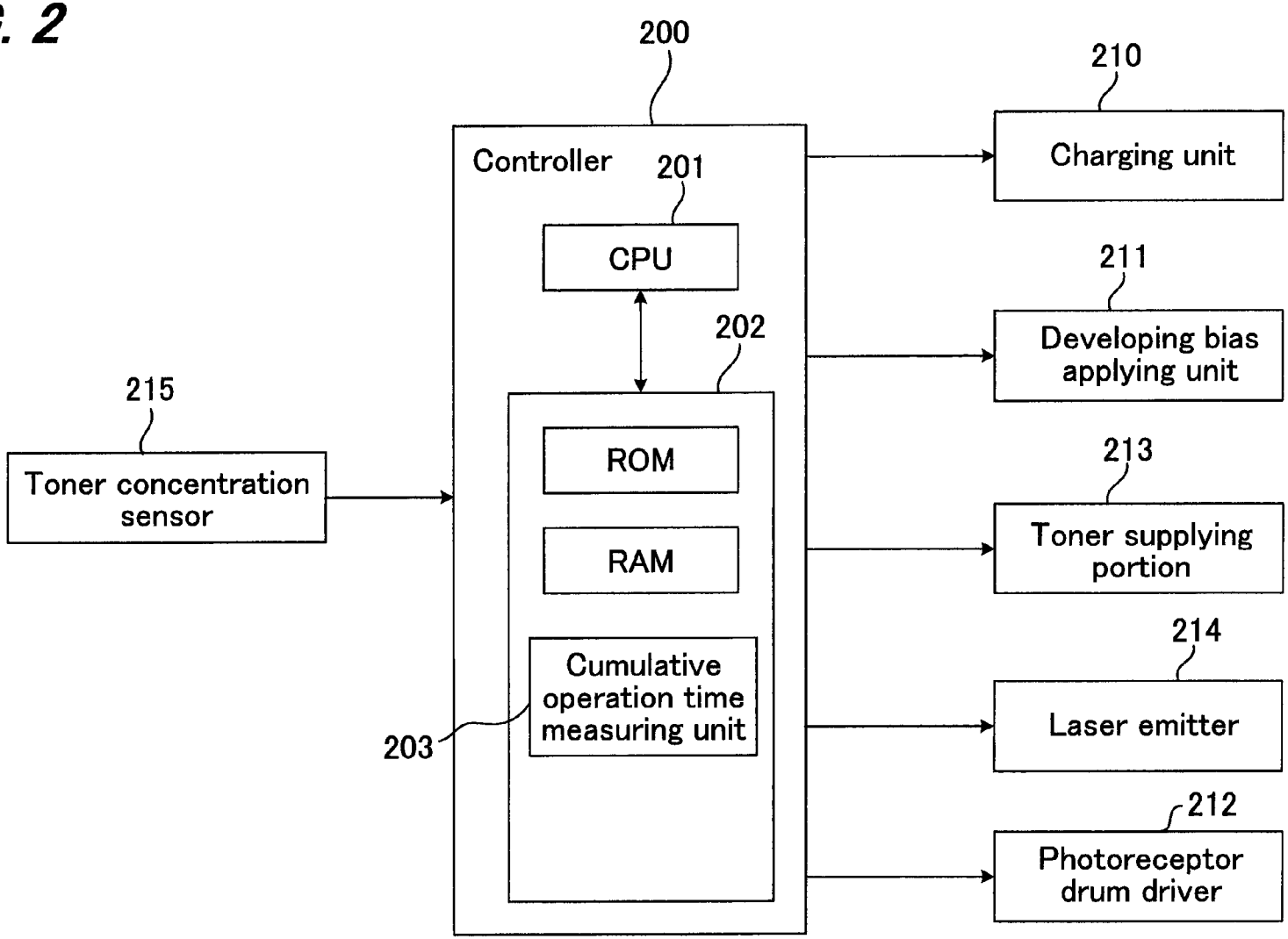
FIG. 2 is a schematic block diagram showing a control system with a centralized controller of an image forming apparatus according to the first embodiment.

FIG. 2 is a schematic block diagram showing a control system with a centralized controller of the image forming apparatus according to the first embodiment.

As shown in FIG. 2, a controller 200 includes a CPU (central processing unit) 201 and a storage 202. Storage 202 stores various control programs and necessary tables, including ROM (read only memory) and RAM (random access memory).

Controller 200 is constructed such that CPU 201 loads each control program from storage 202 and executes the loaded control program to thereby achieve image forming process control.

Controller 200 also includes a control means that receives sensor output signals from diverse sensors and outputs control signals to diverse drives to implement image forming process control and totally governs the whole image forming apparatus.

One example of the sensors is a toner concentration sensor 215 which is disposed in developing unit 102 and detects the toner concentration to keep the content ratio between the toner and carrier at constant. The controller controls and actuates one of the drives, namely a toner supplying portion 213 in developing unit 102 so as to supply toner in accordance with the output signal from this sensor.

The controller also controls a charging unit (charging roller) 210 for uniformly electrifying the photoreceptor drum 101 surface at a predetermined potential, a developing bias applying unit 211, a total operation time measuring unit 203, a photoreceptor drum driver 212, a laser emitter 214 in exposure unit E and the like. The operation of cumulative operation time measuring unit 203 will be described below.

Subsequently, referring to the flow chart of FIG. 3, the operation of image forming apparatus 100 according to the present embodiment will be described.

Figure 3:
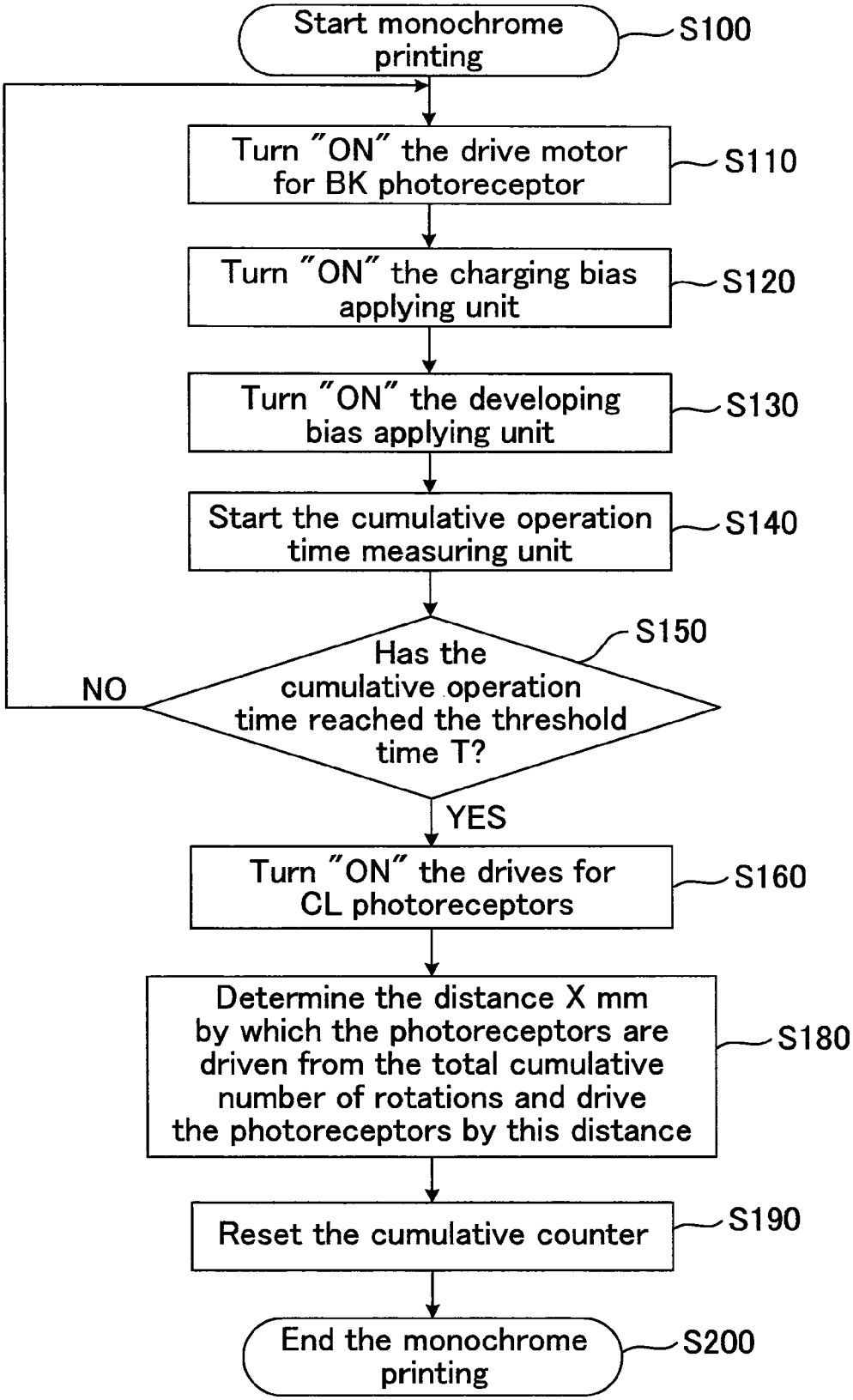
FIG. 3 is a flow chart showing the operation of an image forming apparatus according to the first embodiment.

FIG. 3 is a flow chart showing the operation of the image forming apparatus according to the first embodiment.

When starting monochrome printing (containing text, images, etc.) first (Step S100), controller 200 turns "ON" the motor for driving the monochrome-printing photoreceptor (for BK print) (Step S110). Then, after controlling charging unit 210 so as to apply the bias for charging (Step S120), the controller turns "ON" the developing bias power source (Step S130). With these procedures, an image forming operation is started.

Then, cumulative operation time measuring unit 203 for monochrome printing is actuated (Step S140). The measuring unit renews the cumulative operation time with the progress of printing, and it is determined whether the cumulative operation time on the cumulative operation time measuring unit reaches the cumulative operation threshold time "T" (Step S150). When the cumulative operation time has not yet reached this cumulative operation threshold time "T", the control returns to Step 110 and continues the monochrome printing operation.

Here, specifically this cumulative operation time measuring unit 203 detects the number of printouts or the number of rotations of the photoreceptor drum and calculates the cumulative operation time based on the thus detected value.

Next, when the cumulative operation time reaches this cumulative operation threshold time "T" (Step S150; YES), cumulative operation time measuring unit 203 turns "ON" the drives for the color (CL) printing photoreceptor drums (Step S160). Then, controller 200 perform such control as to move the color (CL) printing photoreceptor drums by X mm (Step S180) and resets the cumulative operation time calculated by cumulative operation time measuring unit 203 (Step S190) and ends the monochrome printing (Step S200).

The reason that the number of printouts or the number of rotations of the monochrome-printing photoreceptor drum is used as the information based on which the cumulative operation time is calculated by cumulative operation time measuring unit 203 is that degradation and wear-out of the coating of the photoreceptor drum depend on the wear-out of the coating due to contact with the recording paper, and that it is possible to exactly reflect coating wear based on the number of rotations of the photoreceptor drum before or after a printing operation.

Though cumulative operation time measuring unit 203 is not necessarily reset, in contrast to the way as it is done at Step S190, it is possible to achieve more precise control without making any special correction if the cumulative operation time is reset every time because the ambient environment and other factors of image forming apparatus 100 is changing.

Further, since, depending on "the total cumulative number of rotations (corresponding to the life of the photoreceptor drum)" of black photoreceptor drum 101*a*, it becomes difficult for the degraded portions to recover or the degraded area of the photosensitive layer becomes greater, as shown in Table 1 below, it is possible to promote recovery of the color-printing photoreceptor drums by performing control such that the "angle (distance)" to be rotated gradually becomes greater as the "total cumulative number of rotations" of black-printing photoreceptor drum 101*a* increases.

Specifically, when the distance X mm each of the color (CL) printing photoreceptor drums is driven is determined, which range the total cumulative number of rotations of black-printing photoreceptor drum 101*a* falls in, of the predetermined classifications as to the total cumulative number of rotations shown in Table 1, is determined first, then the distance X to be driven is selected based on the range thus determined.

TABLE 1

| Total cumulative number of rotations (×rotations) | Distance each color photoreceptor is rotated (mm) |
|---|---|
| ~30K | 10 |
| ~60K | 12 |
| ~90K | 15 |
| ~120K | 18 |
| ~150K | 22 |

at normal temperature

Since the above control rotates each of the color-printing photoreceptor drums so as to position the new surface into place before the photoreceptors are degraded too far, it is possible to restore the photoreceptor surface which is going to be deteriorated.

Similarly, as shown in Table 2, it is possible to have the same effect at above by gradually decreasing the number of rotations (the predetermined time) before the color-printing photoreceptor drums are rotated next, with the increase of the total cumulative number of rotations of the photoreceptor drum.

TABLE 2

| Total cumulative number of rotations (×rotations) | Sheet count at which the color photoreceptor drums are rotated next (rotations) |
|---|---|
| ~30K | Every 3.0K |
| ~60K | Every 2.8K |
| ~90K | Every 2.5K |
| ~120K | Every 2.2K |
| ~150K | Every 1.8K |

at normal temperature

<The Operation of the Image Forming Apparatus According to the Second Embodiment>

Next, the operation of the image forming apparatus according to the second embodiment will be described with reference to the flow chart of FIG. 4.

Figure 4:
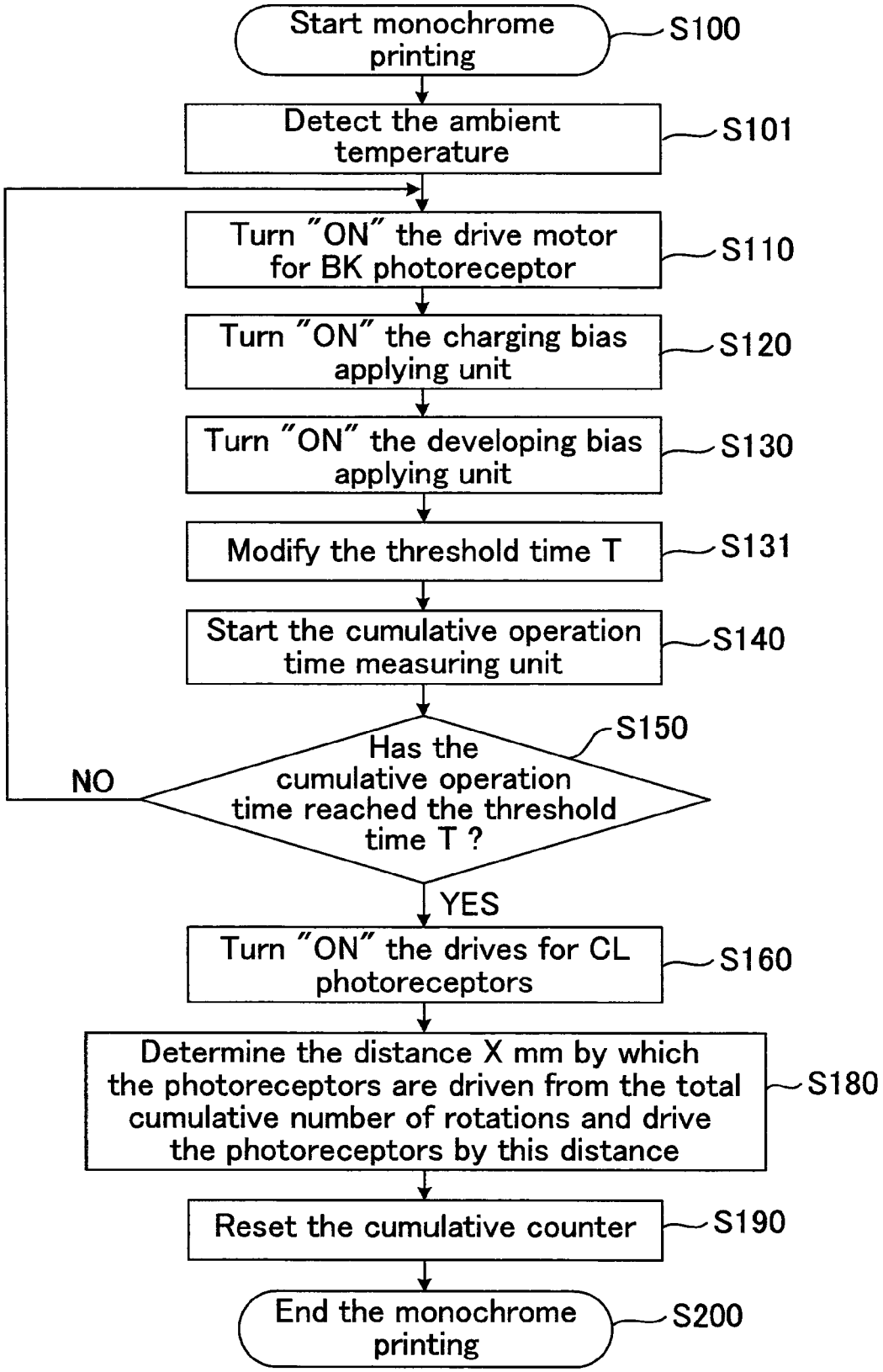
FIG. 4 is a flow chart showing the operation of an image forming apparatus according to the second embodiment.

FIG. 4 is a flow chart for explaining the operation of the image forming apparatus according to the second embodiment. This flow chart is the same as the flow chart for explaining the operation of the image forming apparatus according to the above first embodiment except in that a process regarding the ambient temperature around the apparatus is added.

As shown in Table 3 below, the cumulative operation threshold time "T" is shortened so as to actuate the restoring operation earlier below 20 deg. C. because the cleaning blade becomes harder at the temperature than at normal temperature (20 to 30 deg. C.), hence the photoreceptor coating becomes easily worn down. In contrast, since the coating is worn down slowly when the ambient temperature is 30 deg. C. or higher, the cumulative operation threshold time "T" is made longer so as to start the restoring operation with some delay. This setting makes it possible to obtain equivalently deteriorated condition without depending on the ambient environment.

TABLE 3

| Ambient temperature (deg. C.) | Correction coefficient |
|---|---|
| less than 20 | 0.9 |
| from 20 to less than 30 | 1.0 |
| equal to or greater than 30 | 1.1 |

The flow chart of FIG. 4 showing the operation of controller 200 for performing control based on the above scheme will be explained. The flow chart of FIG. 4 is the flow chart of FIG. 3 that is added with Steps S101 and S131. Step S101 is to receive the temperature information as input from a temperature sensor for measuring the ambient temperature of the apparatus. Step S131 is to modify the cumulative operation threshold time "T" by multiplying the cumulative operation threshold time "T" by a correction coefficient that is selected in accordance with the ambient temperature input at Step S101.

The image forming apparatus of the present invention is not limited to the above embodiments, but various changes and modifications can be added within the scope of the appended claims. That is, any embodied mode obtained by combination of technical means as appropriate without departing from the spirit and scope of the present invention should be included in the technical art of the present invention.

What is claimed is:

1. An image forming apparatus capable of performing monochrome printing and color-printing in a switchable manner, comprising:

a plurality of photoreceptor drums;

a plurality of developing units;

a single intermediate transfer element;

a plurality of drives for driving the plural photoreceptor drums;

a single development transformer for supplying voltage to the plural developing units;

a cumulative operation time measuring unit for calculating cumulative operation time for which the photoreceptor drum for monochrome printing has been used in the monochrome printing; and, a controller for rotationally driving the photoreceptor drums for color printing by a predetermined angle, characterized in that the controller stops rotation of the photoreceptor drums for color printing during monochrome printing while applying the developing voltage from the single development transformer to all the developing units, and compares the cumulative operation time calculated by the cumulative operation time measuring unit with a cumulative operation threshold time and rotationally drives the photoreceptor drums for color printing by a predetermined angle when the cumulative operation time is determined to reach the cumulative operation threshold time, the controller changes a lapse of time before the photoreceptor drums for color printing are rotationally driven, in accordance with the total cumulative number of rotations of the photoreceptor drum for monochrome printing.

2. The image forming apparatus according to claim 1, wherein the cumulative operation time measuring unit calculates the cumulative operation time based on a number of printouts or a rotated time of the photoreceptor drum for monochrome printing.

3. The image forming apparatus according to claim 1, wherein the controller increases the angle by which the photoreceptor drums for color printing are rotationally driven, in accordance with the total cumulative number of rotations of the photoreceptor drum for monochrome printing.

4. The image forming apparatus according to claim 1, further comprising a temperature sensor for measuring an ambient temperature of the apparatus, wherein the cumulative operation time measuring unit modifies the cumulative operation threshold time by multiplying the cumulative operation threshold time by a correction coefficient selected in accordance with the ambient temperature measured by the temperature sensor.

5. The image forming apparatus according to claims 1, wherein the controller resets the cumulative operation time calculated by the cumulative operation time measuring unit when the monochrome printing ends.

6. A drive control method for an image forming apparatus capable of performing monochrome printing and color printing in a switchable manner, including: a plurality of photoreceptor drums; a plurality of developing units; a single development transformer for supplying a developing voltage to the plural developing units; and a single intermediate transfer element, comprising the step of:

stopping rotation of the photoreceptor drums for color printing at the start of monochrome printing while applying the developing voltage from the single development transformer to all the developing units;

calculating a cumulative operation time with a cumulative operation time measuring unit for calculating the cumulative operation time of the photoreceptor drum for monochrome printing;

comparing the cumulative operation time calculated by the cumulative operation time measuring unit for calculating the photoreceptor drum for monochrome printing, with a cumulative operation threshold time to determine whether the cumulative operation time has reached the cumulative operation threshold time;

rotationally driving the photoreceptor drums for color printing by a predetermined angle when the cumulative operation time is determined to have reached the cumulative operation threshold time, and changing a lapse of time before the photoreceptor drums for color printing are rotationally driven, in accordance with the total cumulative number of rotations of the photoreceptor drum for monochrome printing.

* * * * *